United States Patent [19]

Zimmer

[11] 3,986,447

[45] Oct. 19, 1976

[54] PADDING PRESS

[75] Inventor: Edwin F. Zimmer, White Plains, N.Y.

[73] Assignee: Zimmer Industries, Inc., Hawthorne, N.J.

[22] Filed: Feb. 10, 1975

[21] Appl. No.: 548,304

[52] U.S. Cl. ..... 100/219; 11/1 B; 100/226; 100/257

[51] Int. Cl.[2] ..... B30B 15/06

[58] Field of Search ..... 100/219, 226, 233, 257; 11/1 B

[56] References Cited

UNITED STATES PATENTS 2,499,744 3/1950 Goines et al. ..... 100/257

2,708,400 5/1955 Tait ..... 100/226

*Primary Examiner*—Billy J. Wilhite

*Attorney, Agent, or Firm*—James J. Cannon, Jr.; James J. Cannon

[57] ABSTRACT

An improved padding press for holding under pressure a plurality of sheets of paper and cardboard backers while the backs are being glued together to form individual pads, providing a support rack, a pressing mechanism and a plurality of insertable padding racks which enable said support rack and pressing mechanism to be utilized continuously in the padding process. While pads in one insertable padding rack are being glued and dried, another batch can be aligned and pressed in another insertable padding rack.

5 Claims, 9 Drawing Figures

PADDING PRESS

BACKGROUND OF THE INVENTION

1. Field of the Invention

This invention pertains to padding presses which are designed to align, press and glue a plurality of sheets of paper interspersed with cardboard sheets to form, when glued, pads of paper.

2. Description of the Prior Art

The prior art discloses numerous padding presses and paper balers, said paper balers being quite similar in some functions to padding presses. Of all the prior patent devices, only one is similar to the improved padding press disclosed herein.

U.S. Pat. No. 2,499,744, Goines, discloses a padding press having a removable alignment rack. In this unit, an alignment rack is placed on a base; pressure is applied to the padded paper in the rack; a pressure plate is secured to maintain pressure; the alignment rack is removed from the press; and the pads are glued. When the glue dries, the pads are removed; the alignment rack is replaced in the press; and the process is repeated. The removable alignment rack which serves to align the paper and has draw-bars held by thumb nuts for applying pressure to the paper, must be removed in its entirety to glue the pads. Thus, only the base is left free for use with another batch of pads and the rest of the mechanism must be duplicated to provide a continuous padding process. Hence, this patent, while teaching the simplest and most economical prior art, tends to confuse the basic elements of alignment, pressing, gluing and drying, thus confusing the basic structure of a padding press with the auxiliary functions thereof. This results in a very inefficient use of the basic press and an increased production of cost for the products of this padding press.

The present invention represents a distinct improvement over prior art U.S. Pat. No. 2,499,744 in that it distinctly performs alignment and pressing in the basic unit and provides a plurality of insertable racks which serve the functions of gluing and drying. It provides an insertable padding rack which permits utilization of the basic press continuously while previously pressed pads are glued and dried.

SUMMARY OF THE INVENTION

This invention pertains to an improved padding press which includes a plurality of insertable padding racks for holding pressed pads for gluing and drying. The invention comprises a support rack and a pressing mechanism which have provisions for the utilization of one insertable padding rack at a time. The support rack includes a base plate, two side walls, and an upwardly extending rear wall having alignment edges on said rear wall. The pressing mechanism includes a pressure plate pivotally mounted between two pressure arms which are pivotally mounted on two handle arms, said handle arms being pivotally mounted to the rear of the support rack, such that raising the handle in an arcuate movement away from the operator will cause the entire pressing mechanism to swing behind the support rack for easy insertion of a padding rack and alignment of paper. The padding rack includes a base plate, two vertical posts and a pressure plate which slides up and down the vertical posts to press the paper between the two plates. It also includes a locking device to lock its pressure plate on the pressed paper. After an insertable padding rack is positioned in the support rack, and filled with paper to be pressed and padded, the pressing mechanism is pivotally swung forward so that its pressure plate rests on the pressure plate of the insert rack. Pressure is applied by pulling the handle of the pressing mechanism: the pressure plate is locked in place on the insert pressing rack holding the paper under pressure: the pressing mechanism is released: the insert rack with its pressure plate is removed; and the basic press is ready to accept another padding insert, while pads in the prior insertable rack are glued and dried. With the insertable padding rack of the present invention, several racks of pads may be glued and dried simultaneously with the normal operation of the padding press. The resulting efficiency is significant.

DESCRIPTION OF THE PREFERRED EMBODIMENT

Figure 1:
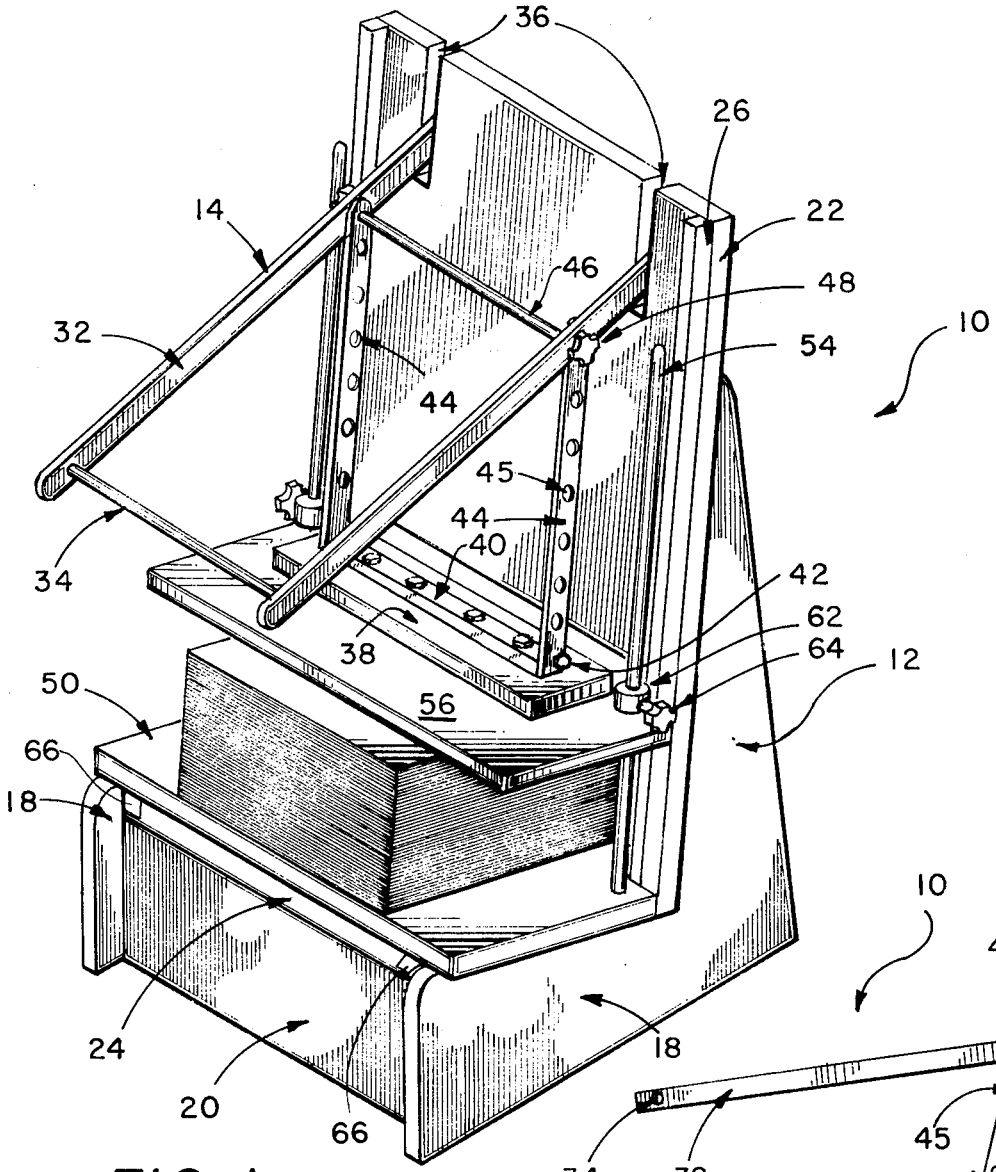
FIG. 1 is a side perspective view of the padding press of the present invention with an insertable padding rack locked into position.
Figure 2:
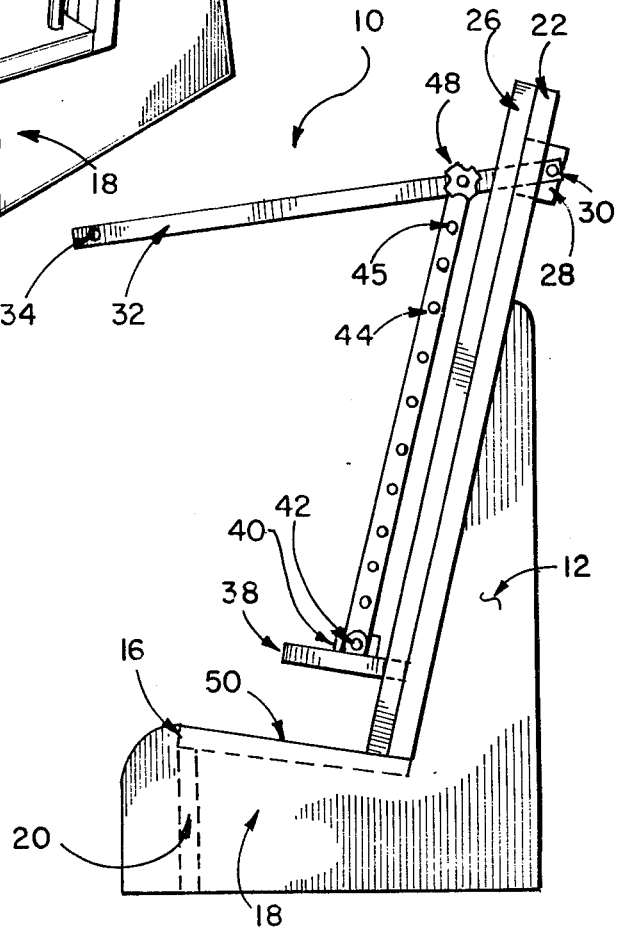
FIG. 2 is a side view of the press of FIG. 1 without an insert rack in position.
Figure 4:
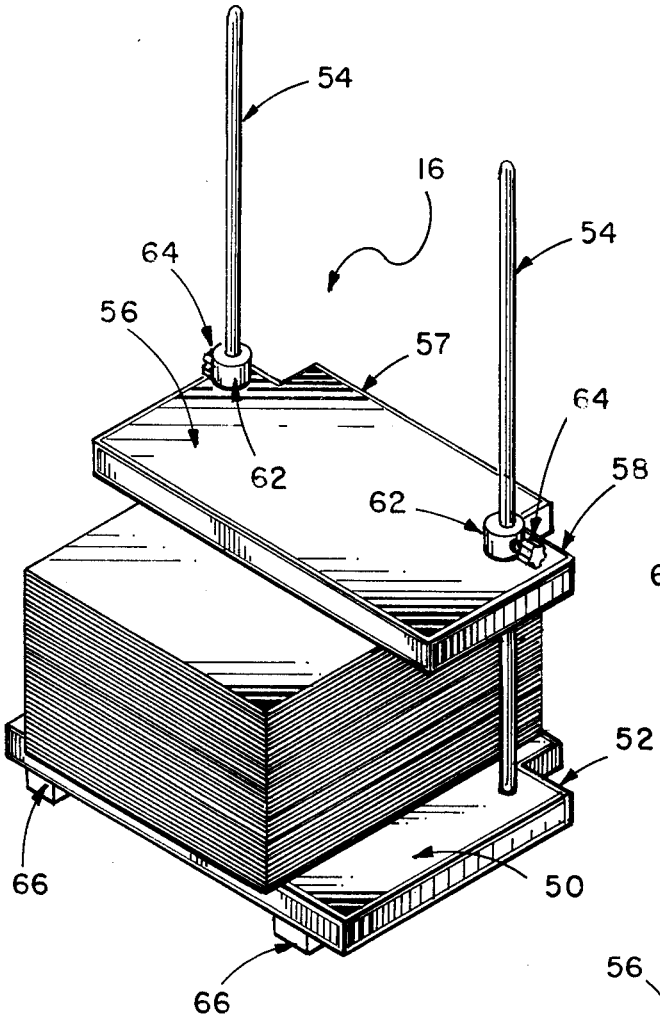
FIG. 4 is a side perspective view of the insert rack of FIG. 3 removed from the press with pads locked in position.
Figure 3:
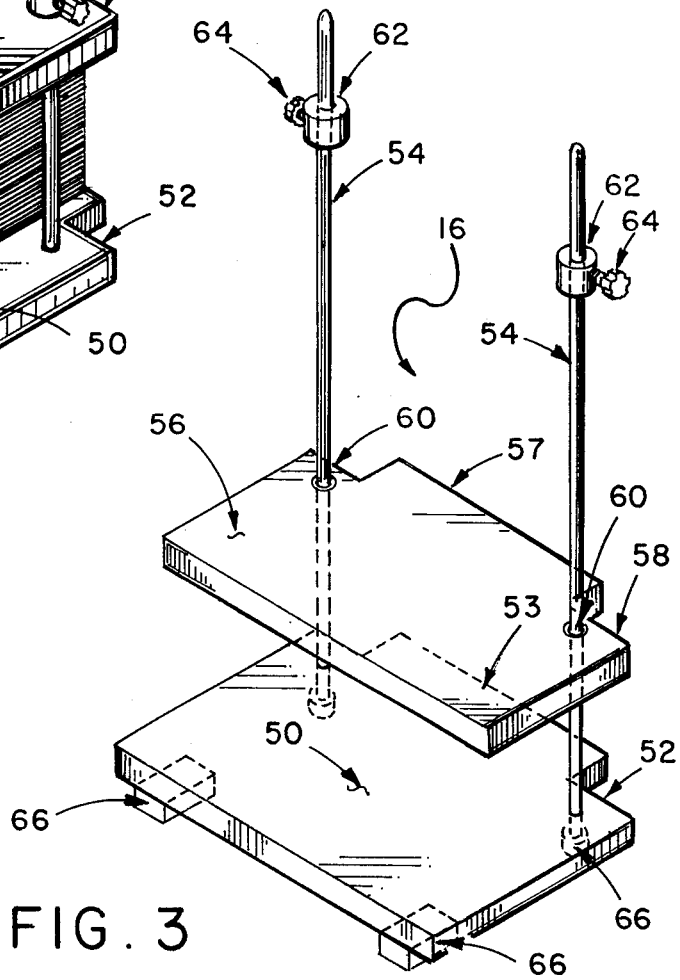
FIG. 3 is a side perspective view of the adjustable padding insert rack for the press of FIG. 1.
Figure 5:
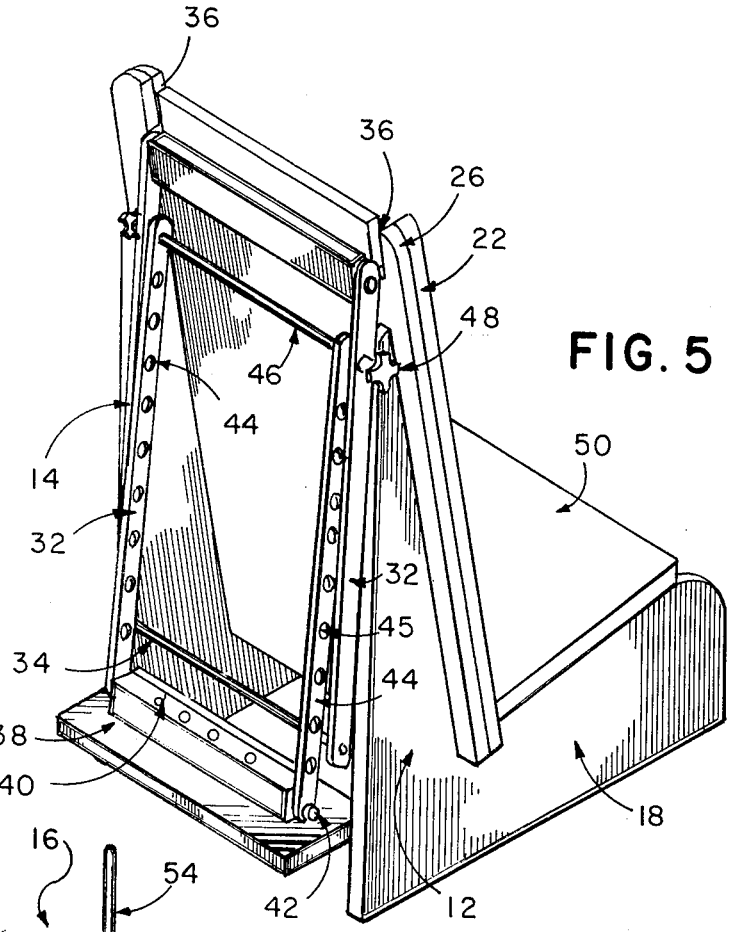
FIG. 5 illustrates the pressing mechanism in its rotated position at the back of the rack of FIG. 1.
Figure 6:
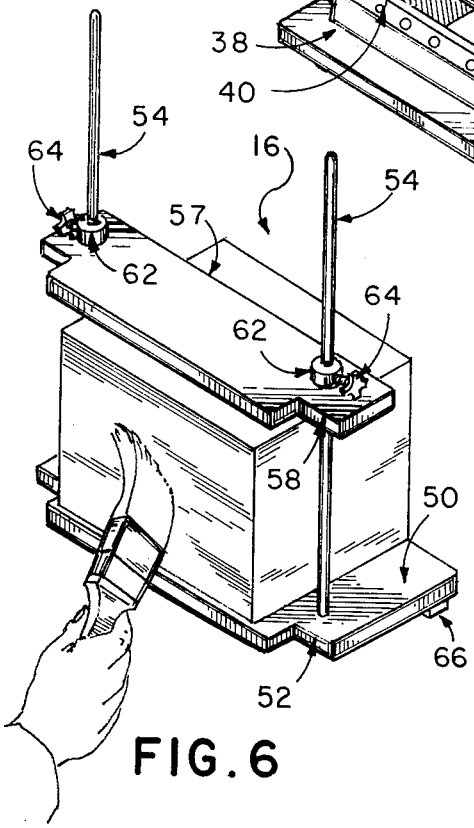
FIG. 6 illustrates the insertable padding rack removed from the press of FIG. 1 reversed to show the edges to be glued.
Figure 7:
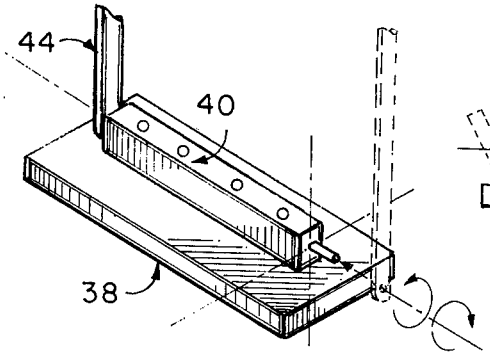
FIGS. 7, 8, and 9 are fragmented perspective, front and side views illustrating the means by which the pressing plate of the invention is rotatably mounted to the pressure bars.
Figure 9:
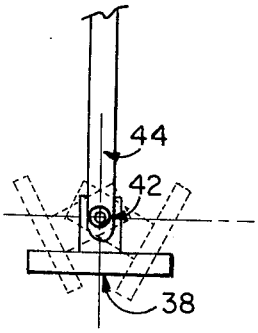
Figure 8:
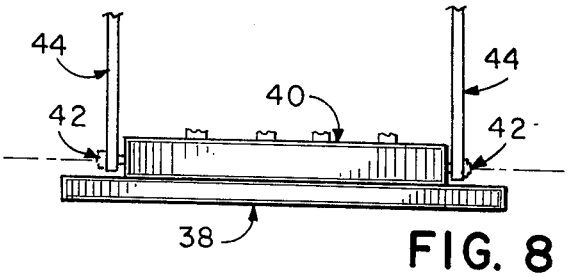

Referring now to the drawings, and in particular to FIG. 1, the reference numeral 10 designates generally the padding press of the present invention, which is there illustrated with a removable and insertable padding rack in position. Padding press 10 includes three principal component assemblies, support rack 12, pressing mechanism 14, (both illustrated also in FIG. 2), and padding rack insert 16 (FIG. 3).

Support rack 12 includes two side walls 18, a front wall 20, an upwardly and rearwardly slanting rear wall 22, a downwardly and rearwardly slanting base plate 24, and alignment edges 26. Support rack 12 serves to support both pressing mechanism 14 and insertable padding rack 16. Pressing mechanism 14 is secured to support rack 12 by a mounting plate 28 attached near the top of the reverse side of rear wall 22 of support rack 12. Two partially threaded cylindrical bolts 30 are received into each side of mounting plate 28. The ends of two handle bars 32 are pivotally mounted between the heads of bolts 30 and the sides of mounting plate 28. The opposite ends of bars 32 are connected by a cylindrical rod 34 which serves as the handle of pressing mechanism 14. Two slots 36 are cut into upper rear wall 22 of support rack 12 to permit handle bars 32 to pivot approximately 270 degrees about the axis of mounting plate 28. Handle 34 and handle bars 32 are used to provide leverage to a pressure plate 38 which is connected to the handle mechanism by a mounting plate 40 having two partially threaded bolts 42 at either end thereof, two pressure bars 44 extending from said bolts 42 to said handle bars 32; and a rod 46 extending through circular openings in said pressure bars 44 and said handle bars 32 and secured in position by two bolts 48 such that said pressure bars 44 can rotate about the axis of rod 46 and said pressure plate 38 can rotate about the axis of said mounting bolts 42. Pressure bars 44 have a series of circular cylindrical openings 45 along their longitudinal axis such that pressure plate 38 may be raised relative to handle bars 32 to adjust for varying thicknesses of the batches of paper to be pressed and padded. Pressure plate 38 is of a width such that it will move relatively snugly but freely between vertical alignment edges 26.

The padding insert rack includes a base plate 50 having corner notches 52 cut in plate 50 to allow its central portion 53 to project inwardly against rear wall 22 and the inner edges of alignment edges 26. It also has two vertical posts 54, one located near each notch 52 and rigidly attached to base plate 50. Padding insert rack 16 has a pressure plate 56 having the same width as base plate 50, similar corner notches 58 and two holes 60 located such that pressure plate 56 may be slidably moved upward and downward on posts 54 with its rear edges 57, notches 58 and side edges aligned with the corresponding edges of base plate 50. Two O-rings 62 are snugly placed on each vertical post over pressure plate 56 and may be secured in position by tightening bolts 64. Four feet 66 are placed on the bottom side of base plate 50 near its four outer corners such that feet 66 project downward beyond the base plate 24 of support rack 12 and serve to hold padding insert 16 firmly in position on support rack 12.

In operation padding press 10 is used as follows. The pressing mechanism 14 is swung out of its operating position by raising handle 34 and rotating it to the rear of support rack 12. Padding insert 16 is placed in position with pressure plate 56 and O-rings 62 removed from posts 54, such that notches 52 of base plate 50 fit as described above. Paper and cardboard to be padded is loaded on the base plate 50 of padding insert 16 and aligned against rear wall 22 and alignment edges 26 of support rack 12. Pressure plate 56 is then slipped down vertical posts 52 and O-rings 62 are also snugly slipped down vertical posts 64 over pressure plate 56. Pressing mechanism 14 is than rotated over to the front of support rack 12 such that its pressure plate 38 lies flat over pressure plate 56. Handle 34 is then pulled downward to press the paper and cardboard; O-rings 62 are tightened with bolts 64 to hold pressure plate 56 in position. With the paper and cardboard now locked in position in padding insert rack 16, pressing mechanism 14 is swung to the rear of support rack 12, padding insert rack 16 is removed therefrom and padding glue is applied to the edges of the pads. While the glue on the pads in insert rack 16 is drying, another padding insert rack 16 may be placed in support rack 12 to commence the pressing process on another batch of pads. Thus, padding press 10 with a plurality of padding insert racks 16 can be used continually while the glue on previously padded batches is drying. Support rack 12 and pressing mechanism 14 need not be unnecessarily duplicated. Additionally, the sliding of pressure plate 56 and O-rings 62 up and down vertical posts 54 permits the padding of non-uniform pads which vary extensively in thickness without cumbersome adjustments. Additional alignment inserts (not shown) may be placed within alignment edges 26 for varying size pads.

Thus padding press 10 with padding rack 16 provides a simple and economical method of continuously padding and glueing batches of pads with a minimum of duplication of equipment.

I claim:

1. An improved padding press for pressing and holding under pressure a plurality of pads while the back edges are being glued comprising in combination:

a support rack including two side walls, an upwardly extending rear wall and a base plate;

said rear wall having alignment edges secured thereto, a paper pressing mechanism rotatably mounted on said supporting rack including a mounting bar, a pair of handle arms rotatably secured to said mounting bar, a handle mounted to said handle arms, two pressing plate arms rotatably mounted on said handle arms, a pressure plate rotatably mounted on said pressure plate arms;

an insertable padding rack including a base plate, notched to fit within said alignment edges of said support rack, two vertical bars attached to said base plate, a notched pressure plate to fit over said base plate and slidably received over said vertical bars through two aperatures in said pressure plate, two adjustable O-rings slidably received over said vertical bars to retain said pressure plate in position.

2. An improved padding press as defined in claim 1 wherein the base plate and the upwardly extending rear wall of said support rack slant rearwardly to retain more securely the insertable padding rack.

3. The improved padding press as defined in claim 1 wherein said pressing mechanism is secured to the reverse side of said rear wall of said support rack and said rear wall of said support rack has two slots therein to permit the handle arms of said pressing mechanism to be rotated freely from the front to the rear of said support rack.

4. The improved padding press of claim 1 wherein said pressing mechanism includes a plurality of circular aperatures along the length of said pressure arms to permit the length of said arms to be adjusted to varying thicknesses of batches of paper to be pressed.

5. The improved padding press of claim 1 wherein the base plate of said padding insert rack extends slightly beyond the side edges of said base plate of said support rack and has feet on the bottom side of its base plate to align said padding insert rack on said support rack and to permit said padding insert rack to stand freely in level upright position.

* * * * *